US009962763B2

(12) United States Patent
Digard Brou De Cuissart et al.

(10) Patent No.: US 9,962,763 B2
(45) Date of Patent: May 8, 2018

(54) CASTING METHOD FOR OBTAINING A PART INCLUDING A TAPERING PORTION

(71) Applicant: SNECMA, Paris (FR)

(72) Inventors: Sebastien Digard Brou De Cuissart, Paris (FR); Josserand Bassery, Courbevoie (FR); Stephanie Deflandre, Conflans Sainte Honorine (FR)

(73) Assignee: SNECMA, Paris (FR)

( * ) Notice: Subject to any disclaimer, the term of this patent is extended or adjusted under 35 U.S.C. 154(b) by 1272 days.

(21) Appl. No.: 13/913,759

(22) Filed: Jun. 10, 2013

(65) Prior Publication Data

US 2013/0330201 A1 Dec. 12, 2013

(30) Foreign Application Priority Data

Jun. 11, 2012 (FR) ..... 12 55425

(51) Int. Cl.

| | |
|---|---|
| ***B22D 25/02*** | (2006.01) |
| ***B22C 7/02*** | (2006.01) |
| ***B22C 9/04*** | (2006.01) |
| ***B22C 9/24*** | (2006.01) |
| ***B22D 19/00*** | (2006.01) |
| ***B22D 19/04*** | (2006.01) |
| ***F01D 5/14*** | (2006.01) |

(52) U.S. Cl.

CPC ..... *B22D 25/02* (2013.01); *B22C 7/02* (2013.01); *B22C 9/04* (2013.01); *B22C 9/043* (2013.01); *B22C 9/24* (2013.01); *B22D 19/0072* (2013.01); *B22D 19/04* (2013.01); *F01D 5/147* (2013.01); *F05D 2230/21* (2013.01); *F05D 2240/304* (2013.01)

(58) Field of Classification Search

CPC .... B22D 25/02; B22D 19/0072; B22D 19/04; B22C 9/043; B22C 7/02; B22C 9/04; B22C 9/24; F01D 5/147

See application file for complete search history.

(56) References Cited

U.S. PATENT DOCUMENTS 3,215,511 A 11/1965 Chisholm et al.
5,083,903 A 1/1992 Erdmann
(Continued)

FOREIGN PATENT DOCUMENTS

DE 1 972 611 11/1967
EP 1 481 747 A2 12/2004
(Continued)

OTHER PUBLICATIONS

Examination Report under Section 18(3) dated Nov. 7, 2014 in United Kingdom Patent Application No. GB1310331.2.
(Continued)

*Primary Examiner* — Woody Lee, Jr.
*Assistant Examiner* — Maxime Adjagbe
(74) *Attorney, Agent, or Firm* — Oblon, McClelland, Maier & Neustadt, L.L.P.

(57) ABSTRACT

A casting method for obtaining a part that includes a tapering portion, and a turbine engine blade obtained by casting and including a tapering trailing edge, are provided. The method includes: providing an insert element having a tapering section; making a shell around the insert element; and casting a molten material into the shell including the insert element.

9 Claims, 3 Drawing Sheets

(56) References Cited

U.S. PATENT DOCUMENTS

| | | | | |
|---|---|---|---|---|
| 5,823,243 | A * | 10/1998 | Kelly | B22D 27/20 164/516 |
| 7,674,093 | B2 * | 3/2010 | Lee | B22C 9/103 164/365 |
| 7,757,745 | B2 * | 7/2010 | Luczak | B22C 9/04 164/28 |
| 8,147,205 | B2 | 4/2012 | Digard Brou De Cuissart et al. | |
| 8,167,537 | B1 | 5/2012 | Plank et al. | |
| 2006/0090871 | A1 | 5/2006 | Snyder et al. | |
| 2007/0114001 | A1 | 5/2007 | Snyder et al. | |
| 2007/0240845 | A1 | 10/2007 | Graham et al. | |
| 2007/0261814 | A1 | 11/2007 | Luczak | |
| 2008/0169412 | A1 | 7/2008 | Snyder et al. | |
| 2010/0206512 | A1 | 8/2010 | Dube et al. | |
| 2011/0113627 | A1 | 5/2011 | Alquier et al. | |

FOREIGN PATENT DOCUMENTS

| | | | |
|---|---|---|---|
| EP | 1 652 603 | A2 | 5/2006 |
| EP | 1 854 567 | A2 | 11/2007 |
| EP | 2 223 753 | A1 | 9/2010 |
| GB | 2 062 530 | A | 5/1981 |
| JP | 2001-38461 | | 2/2001 |
| WO | WO 03/051559 | A1 | 6/2003 |
| WO | WO 2011/161385 | A1 | 12/2011 |

OTHER PUBLICATIONS

French Preliminary Search Report filed Mar. 1, 2013 in French 12 55425, filed on Jun. 11, 2012 ( with English Translation of Category of Cited Documents).

French Preliminary Search Report filed Jul. 6, 2012 in French 11 60580 ( with English Translation of Category of Cited Documents).

* cited by examiner

CASTING METHOD FOR OBTAINING A PART INCLUDING A TAPERING PORTION

FIELD OF THE INVENTION

The present description relates to a casting method for obtaining a part that includes a tapering portion, and also to a turbine engine blade obtained by casting and including a tapering trailing edge.

Such a casting method may be used for obtaining a tapering part without gaps of material appearing on unmolding. It is thus possible by casting to produce parts that are highly tapered, such as turbine engine blades presenting fine trailing edges that procure high aerodynamic performance, or to produce other complex tapering parts of the kind that may be of use in the field of aviation, for example.

STATE OF THE PRIOR ART

Certain industries require parts to be produced that include highly tapered portions making it possible to procure certain properties for such parts or their environment. For example, in a turbine engine, it is known that the fineness of the trailing edges of turbine blades has a strong influence on their aerodynamic properties, and therefore on the overall efficiency of the turbine. Thus, in such an example, it is desired to obtain blades having trailing edges of a thickness that is less than 1 millimeter (mm).

Casting is the technique that is in the most widespread use at present for making parts of this type, and in prior art casting techniques it is not possible to obtain such tapering parts in reliable manner. Below a certain thickness, the material being cast does not manage to spread throughout the entire volume of the mold, and most particularly into the narrowest interstices, and that leads to gaps of material in the ends of the tapering portions of the part.

Under such circumstances, it is possible to select a material that provides better castability, but such a change in the material is generally to the detriment of other properties, in particular such as the mechanical strength or the high temperature performance of the part. In addition, such a material may be more expensive.

Another solution is to use centrifugal molds that make it possible to use the drive of centrifugal force to entrain the material being cast to the tips of the tapering portions of the mold. Nevertheless, such centrifugal molds are expensive and more difficult to operate, thus requiring the entire casting method to be revised.

There therefore exists a real need for a casting method making it possible to obtain a tapering part while avoiding, at least in part, the above-mentioned drawbacks that are inherent to known methods.

SUMMARY OF THE INVENTION

The present invention provides a casting method for obtaining a part that includes a tapering portion, wherein the method comprises the following steps: providing an insert element having a tapering portion; making a shell around the insert element; and casting a molten material into said shell including the insert element.

The shell is made around the insert element in such a manner as to create a mold having the shape of the part that is to be obtained and in which the insert element is already present. Under such circumstances, when the molten material is cast into the shell, it flows throughout the available space and it meets the insert element. While the molten material is cooling it bonds with the insert element, by impregnation or in particular by forming a solid solution at their interface, such that after cooling the raw casting is made up of a main portion constituted by the now-solidified cast material and by a portion constituted by the insert element, the insert element constituting a tapering portion of the part as obtained in this way.

Thus, in such a method, it is possible to make a raw casting made up of two different portions. As from the casting step, it is thus possible to provide a mechanical part with a zone that is very fine and that imparts certain specific properties thereto, in particular aerodynamic properties. In other words, it is possible to obtain a tapering part regardless of the material used for casting and to omit subsequent machining steps seeking to taper the part after it has been unmolded. In particular, it is possible to select materials that present advantageous physicochemical properties without their poor castability making them unusable. Finally, the number of manual steps is reduced and the technicality of the overall method is reduced. The method is thus easier to implement and less expensive.

In addition, by means of such a method, the solidified material and the insert element may present properties that are different. Thus, as from the casting step, it is possible to provide a mechanical part with two zones that present different properties, each of them being adapted to the constraints and the environment to which it is to be confronted.

In the present description, the term "tapering" portion is used to mean a portion of thickness that is fine relative to its characteristic size. In particular, it may be a portion of thickness that is less than 1 millimeter, and more particularly less than 0.6 mm.

In certain implementations, the step of making the shell comprises the following steps, performed in this order: providing a mold reproducing the shape of the part that is to be obtained; inserting the insert element in said mold in a location corresponding to its final location in the part that is to be obtained; injecting wax into said mold and obtaining a wax model including the insert element; molding the shell around the wax model including the insert element; and firing the shell and removing the wax.

This lost wax method makes it possible to position the insert element very accurately and very easily in the desired location of the part that is to be obtained. In the meaning of the invention, the term "wax" should be understood as covering any low-melting point material that presents a certain degree of plasticity: it may be an animal, vegetable, or artificial wax such as paraffin, or a silicone wax, or certain plastics materials. While the wax is being injected, it flows throughout the available space within the mold and it encounters the insert element and holds it captive: this produces a wax model that includes the insert element at the precise location it is to occupy in the final part that is to be obtained. Since the shape of the wax model including the insert element is the same as the shape of the part that is to be obtained, the shell is molded around the wax and the insert element using the traditional technique. While firing the shell and removing the wax, the shell holds the insert element captive, whereas the wax melts and leaves a void into which the molten material is to be cast: the insert element thus continues to be positioned in the desired location and is ready to meet the molten material.

In certain implementations, the mold is a reusable metal mold. Thus, all of the parts produced with this mold will have the same accurate shape, thereby limiting departures from the desired shape and thus limiting shape-correcting machining steps. In addition, reusing the mold gives rise to savings. In particular, in certain circumstances, it is possible to use already-existing molds that have been used in prior methods without adapting them in any particular way, or, if that is not possible, at the cost of making small adaptations that are easy to perform.

In certain implementations, the insert element includes recesses into which the molten material can penetrate during casting. These recesses ensure that the insert element is secured more strongly with the remainder of the part, the molten material holding the insert element captive when it solidifies in the recesses. The same applies with the molten wax that can likewise penetrate into the same recesses, solidify, and hold the insert element captive in the same way.

In certain implementations, these recesses are cavities made within the insert element and they present access ducts for the molten material or the wax. In particular, they may be channels.

In certain implementations, these recesses are grooves in the surface of the insert element at the interface with the molten material or the wax. These grooves serve to increase the attachment surface area with the molten material or the wax and thus to increase the strength of the bonding between the insert element and the main portion of the part.

In certain implementations, instead of recesses, or in addition thereto, the insert element presents projections shaped to be embedded in the cast material so as to provide bonding between the insert element and the main portion of the part.

In certain implementations, the insert element is heated to a temperature close to that of the molten material during casting. In this way, the formation of a solid solution at the interface between the insert element and the molten material is encouraged, thereby increasing the strength of the bonding between these two portions of the part.

In certain implementations, the insert element is heated merely by heat exchange with the molten material.

In certain implementations, the molten material is cast into the shell before the insert element has had time to cool after the step of firing the shell.

In certain implementations, the insert element is a part presenting a tapering portion of thickness less than 1 mm, or indeed less than 0.5 mm.

In certain implementations, the insert element comprises a first material from the family of metals.

In other implementations, the insert element comprises a first material from the family of composites. Nevertheless, any other appropriate material could equally well be used, whether metallic or otherwise.

In certain implementations, the cast molten material is a second material from the family of metals, and is preferably a titanium-aluminum alloy.

In other implementations, the insert element is made of the same material as the molten casting material. It may optionally be previously subjected to special treatments that modify its properties. For example, it may have previously been subjected to annealing, quenching, or any other heat treatment.

In certain implementations, the method includes steps of pre-treating the insert element. By way of example, this may involve a shaping or machining operation, possibly together with heat treatments or chemical treatments.

In certain implementations, the method includes steps of post-treatment on the part obtained at the end of casting. By way of example, this may comprise cutting, boring, surfacing, or any other mechanical machining step, or it may comprise physicochemical treatment.

In certain implementations, a plurality of insert elements are provided that are arranged in different locations. These insert elements may be identical, in particular being made of the same material, or they may be different in order to comply with specific different requirements.

In certain implementations, the part that is to be obtained is a blade for a turbine engine, and in particular a turbine blade.

In such implementations, the insert element is arranged within the shell in the zone that is to become the trailing edge of the blade. This makes it possible to obtain a blade having a highly tapered trailing edge, thus providing an aerodynamic profile of high quality.

The present description also relates to a turbine engine blade obtained by casting and including an insert portion forming a trailing edge of thickness that is less than 1 mm. Such a turbine engine blade does not require any reworking or tapering of its trailing edge after casting: it is therefore easier and less expensive to produce.

In certain embodiments, this insert portion forming the trailing edge is a fine flat plate of thickness that is preferably less than 0.5 mm, more preferably of thickness of about 0.3 mm, and it is arranged to extend the pressure side or the suction side.

In other embodiments, the trailing edge is made up of two fine flat plates, each of thickness preferably less than 0.5 mm, and more preferably of thickness of about 0.3 mm, and they are arranged respectively to extend the pressure side and the suction side of the blade.

In other embodiments, the insert portion reproduces the entire shape of the trailing edge extending both the pressure side and the suction side of the blade to a common end.

In certain embodiments, the turbine engine blade is obtained by a method as described above.

The above-described characteristics and advantages, and others, appear on reading the following detailed description of an implementation of the proposed method. This detailed description refers to the accompanying drawings.

BRIEF DESCRIPTION OF THE DRAWINGS

The accompanying drawings are diagrammatic and seek above all to illustrate the principles of the invention. In the drawings, from one figure to another, elements (or portions of an element) that are identical are referenced by the same reference signs.

DETAILED DESCRIPTION OF EMBODIMENTS

In order to obtain a more concrete idea about the invention, an example method is described in detail below with reference to the accompanying drawings. It should be recalled that the invention is not limited to this example.

FIGS. 1A to 1H show the various steps in an example implementation of the casting method. It seeks to obtain a final part 80 having a main portion 81 and a tapering insert portion 82. In this implementation, the desired part is a turbine blade and the insert portion 82 is its trailing edge. Naturally the parts that it is desired to obtain may be much more complicated and may in particular include a plurality of insert portions of sizes and mechanical properties that may be identical or different.

Figure 1A:
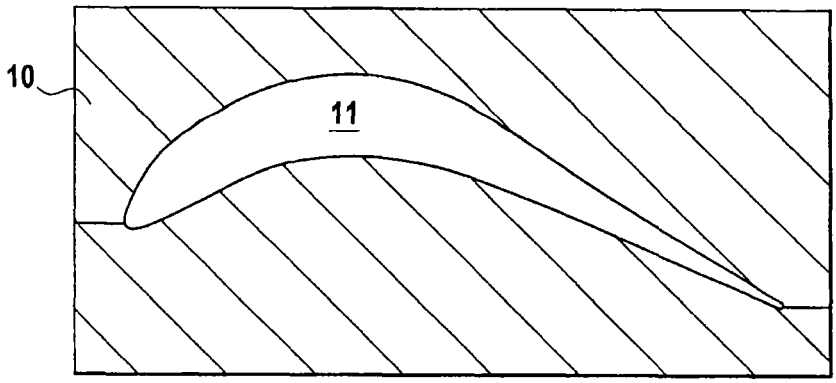
FIGS. 1A to 1H show eight successive steps in an example of the method.

In FIG. 1A, a metal mold 10 is provided. The mold has a cavity 11 forming a negative of the exact shape of the final part 80, i.e., in this example, a blade-shaped hollow.

Figure 1B:
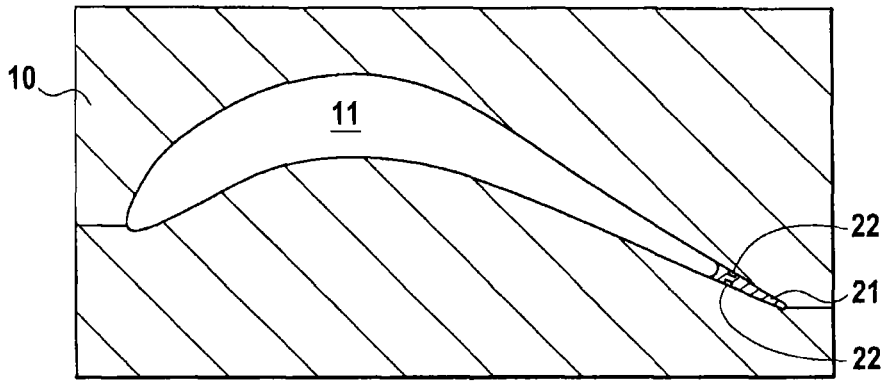

As shown in FIG. 1B, an insert element 21 is inserted in the cavity 11 of the mold 10 precisely at the location that corresponds to its final position in the final part 80. In this example, it is a tapering trailing edge having a thickness of about 0.7 mm. Naturally, the insert element 21 is prepared and shaped so as to enable it to be inserted in the cavity 11: in particular it is provided with the appropriate dimensions. Recesses 22 are also formed in the insert element 21. The insert element 21 may also be subjected to physiochemical treatments in order to provide it with advantageous properties. If necessary, fastener means may enable the insert element 21 to be held in place in the cavity 11 of the mold 10. In other implementations, instead of recesses 22 or in addition thereto, the insert element 21 may have projections that are to become embedded in the cast material so as to provide cohesion between the insert element 21 and the bulk of the finished part.

Figure 1C:
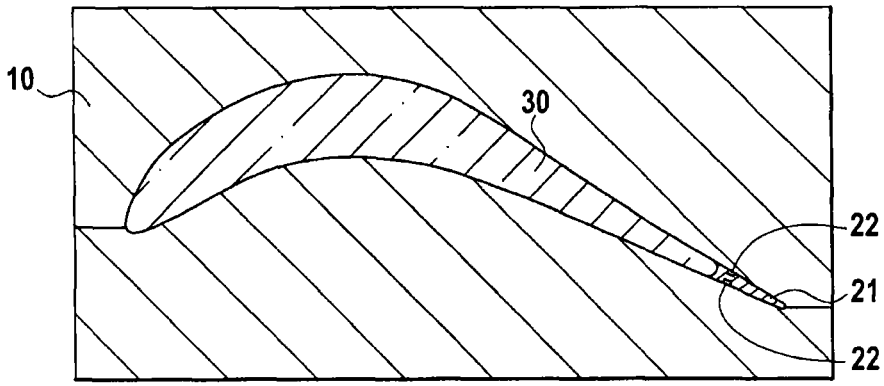

As shown in FIG. 1C, wax 30 is then injected into the cavity 11 of the mold 10. The wax fills the cavity 11 completely together with the recesses 22 in the insert element 21. Once solidified, the wax 30 holds the insert element 21 captive.

Figure 1D:
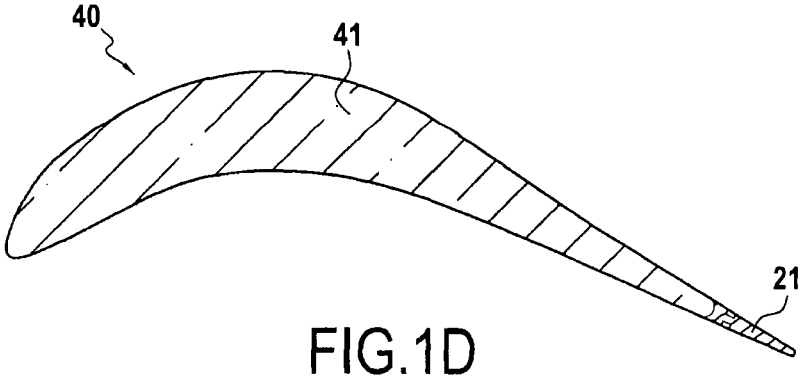

It is then possible to unmold the wax model 40 as obtained and as shown in FIG. 1D. This model comprises a main portion 41 that is made of wax derived from the wax 30 that has solidified, together with the insert element 21 secured to the wax main portion 41. The wax model 40 thus presents the exact shape of the final part 80, the insert element 21 being situated exactly in the position of the future insert portion 82.

Figure 1E:
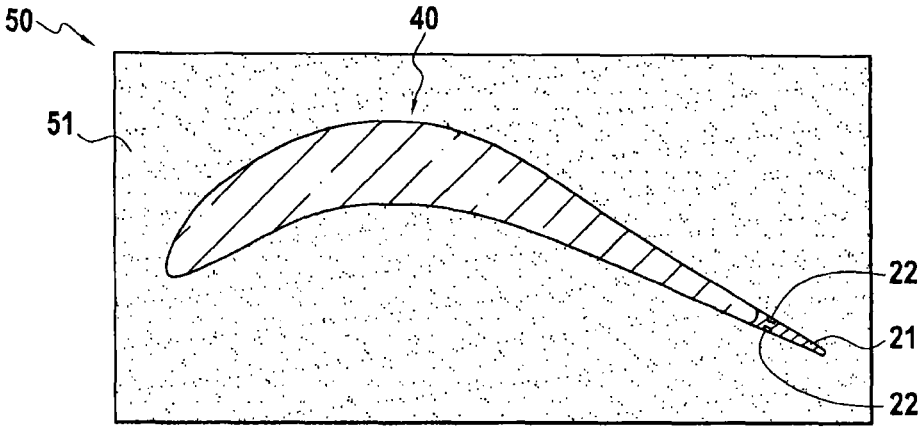

As shown in FIG. 1E, a shell 50 is then molded around the wax model 40. For example, the wax model 40 may be embedded in a powder of refractory material 51. Successive layers of refractory material 51 may be put into place. Feed chimneys may also be provided for use in subsequent casting.

Figure 1F:
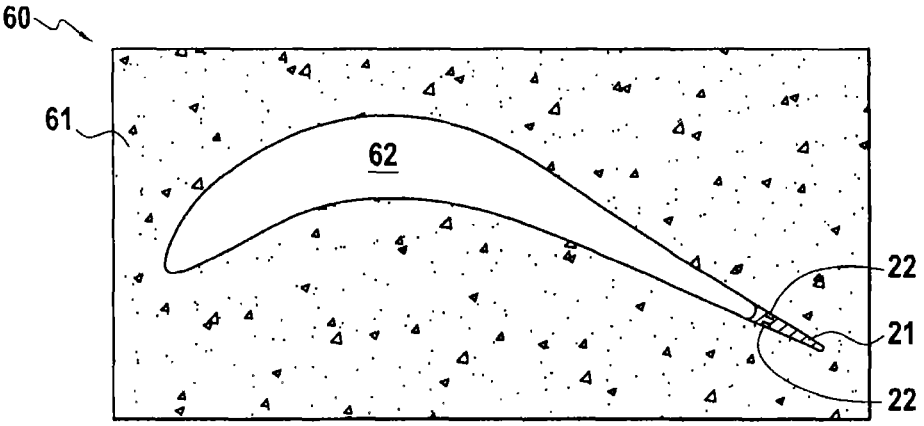

As shown in FIG. 1F, the shell 50 is then fired, e.g. in a kiln. The refractory material powder 51 then transforms into a ceramic 61 forming a solidified shell 60. At the same time, under the effect of heat, the wax melts and is discharged, thus leaving behind a cavity 62. This produces a solidified shell 60 that includes the insert element 21 still in the correct position and a cavity 62 presenting the shape of the main portion 81 of the final part 80.

Figure 1G:
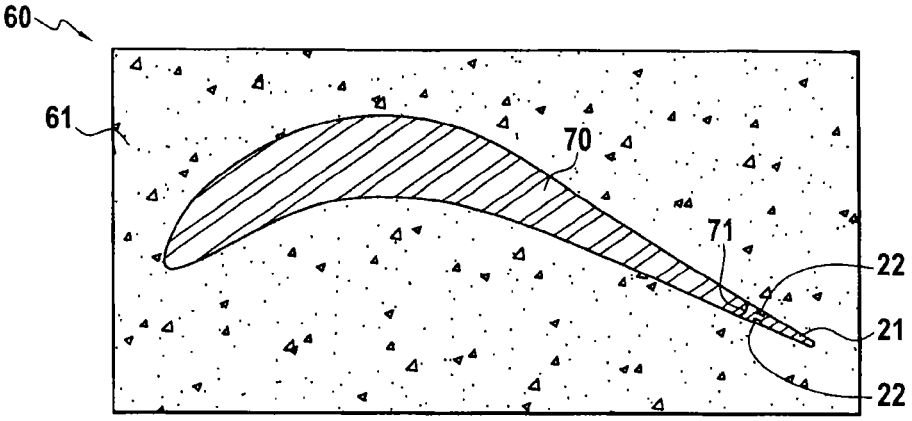

Thereafter, as shown in FIG. 1G, a molten material 70, in this example a TiAl alloy, can be cast via the feed chimneys. The molten material 70 then fills all of the space available inside the shell 60, i.e. the cavity 62 and the recesses 22 in the insert element 21. The shell and the casting are then allowed to cool. In this implementation, the insert element 21 is made of metal. Thus, during cooling, at the interface 71 between the molten material 70 and the insert element 21, the two materials diffuse and interpenetrate. In other implementations, the insert element 21 may be made of composite material: under such circumstances, overall cohesion is provided mainly by the complementary shapes of the insert element 21 and the cast material 70 once it has solidified.

Figure 1H:
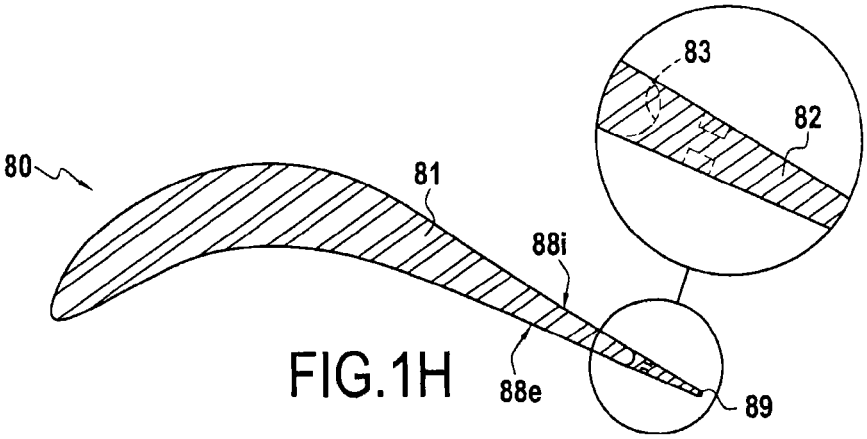

Once cooling has terminated, the shell 60 is broken and the final part 80 is obtained as shown in FIG. 1H, in which the molten material 70 has solidified to give the main portion 81, while the insert element 21 is secured to the main portion 81 so as to constitute the insert portion 82. Depending on the conditions under which casting is performed, a transition zone 83 of greater or lesser size is present between the main portion 81 and the insert portion 82: in this transition zone 83, the two materials are in solid solution in varying proportions.

Thus, FIG. 1H shows a first embodiment of a turbine blade obtained by casting and having a tapering trailing edge. In this example, the insert portion 82 reproduces the complete shape of the trailing edge extending the pressure side 88*i* and the suction side 88*e* of the blade to a common end 89; its thickness is then about 0.7 mm and it decreases down to its end 89.

Figure 2:
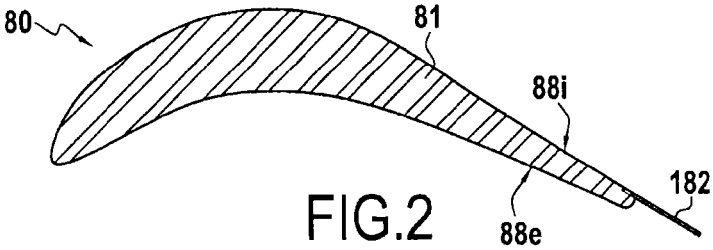
FIG. 2 shows an alternative embodiment of a turbine engine blade.

FIG. 2 shows a second embodiment of a turbine blade obtained by casting and having a tapering trailing edge. In this second example, the insert portion is a fine flat plate 182 having a thickness of 0.3 mm and arranged to extend the suction side 88*e* of the blade.

Figure 3:
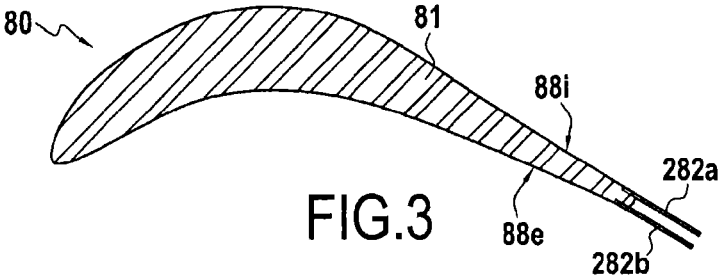
FIG. 3 shows another alternative embodiment of a turbine engine blade.

FIG. 3 shows a third embodiment of a turbine blade obtained by casting and having a tapering trailing edge. In this third embodiment, the insert portion comprises a first fine flat plate 282*a* having a thickness of 0.3 mm arranged to extend the suction side 88*e* of the blade, and a second fine flat plate 282*b* having a thickness of 0.3 mm and arranged to extend the pressure side 88*i* of the blade.

the implementations and embodiments described herein are given by way of non-limiting illustration, and on the basis of this description, a person skilled in the art can easily modify these implementations and embodiments or can envisage others, while remaining within the scope of the invention.

Furthermore, the various characteristics of these implementations and embodiments may be used singly or in combination. When they are used in combination, these characteristics may be used as described above or in some other way, the invention not being limited to the specific combinations that are described in the present description. In particular, unless specified to the contrary, a characteristic described with reference to one implementation or embodiment may be applied in analogous manner to another implementation or embodiment.

What is claimed is:

1. A casting method for obtaining a blade for a turbine engine that includes a tapering trailing edge, the method comprising:

providing an insert element having a tapering section;

making a shell around the insert element; and casting a molten material into said shell including the insert element, wherein said tapering trailing edge of the blade is constituted by said tapering section of said insert element wherein the molten material is a material from the family of metals.

2. A method according to claim 1, wherein the making the shell comprises, in order:

providing a mold reproducing a shape of the blade that is to be obtained;

inserting the insert element in said mold in a location corresponding to the trailing edge of the blade that is to be obtained;

injecting wax into said mold and obtaining a wax model including the insert element;

molding the shell around the wax model including the insert element; and firing the shell and removing the wax.

3. A method according to claim 2, wherein the mold is a reusable metal mold.

4. A method according to claim 1, wherein the insert element includes recesses into which the molten material can penetrate during casting.

5. A method according to claim 1, wherein the insert element is heated to a temperature close to that of the molten material during casting.

6. A method according to claim 1, wherein a thickness of the tapering section of the insert element is less than 1 mm.

7. A method according to claim 1, wherein the insert element includes a composite material.

8. A method according to claim 7, wherein the shell includes a cavity presenting a shape of a main portion of the obtained blade, and the obtained blade presents a transition zone between the main portion and the insert element, in which transition zone the molten material and material of the insert element are in solid solution.

9. A method according to claim 1, wherein the molten material is a titanium-aluminum alloy.

* * * * *